United States Patent [19]

Ikeda et al.

[11] Patent Number: 4,762,468

[45] Date of Patent: Aug. 9, 1988

[54] SHOE-AND-SOCKET JOINT IN A SWASH PLATE TYPE COMPRESSOR

[75] Inventors: Hayato Ikeda; Satoshi Kitahama; Hiroshi Onomura, all of Kariya, Japan

[73] Assignee: Kabushiki Kaisha Toyoda Jidoshokki Seisakusho, Aichi, Japan

[21] Appl. No.: 86,925

[22] Filed: Aug. 18, 1987

[30] Foreign Application Priority Data

Aug. 25, 1986 [JP] Japan ..... 61-129061[U]

[51] Int. Cl.[4] ..... F04B 1/16; F01B 3/00

[52] U.S. Cl. ..... 417/269; 92/71

[58] Field of Search ..... 417/269; 92/71; 74/60

[56] References Cited

U.S. PATENT DOCUMENTS 4,662,267 5/1987 Kaku et al. ..... 417/269

4,683,803 4/1987 Miller et al. ..... 417/269

FOREIGN PATENT DOCUMENTS 135990 6/1986 Japan ..... 417/269

*Primary Examiner*—William L. Freeh

*Attorney, Agent, or Firm*—Burgess, Ryan & Wayne

[57] ABSTRACT

A swash plate type compressor comprising a swash plate and a plurality of double headed pistons reciprocatingly moved by the swash plate through a shoe-and-socket joint. The shoe and socket are shaped in a mating semi-spherical convex and concave configuration which has a center of curvature which is offset from the axis of the piston circumferentially of the swash plate to mitigate the swinging motion of the pistons and decrease the noise of the compressor.

6 Claims, 3 Drawing Sheets

SHOE-AND-SOCKET JOINT IN A SWASH PLATE TYPE COMPRESSORBACKGROUND OF THE INVENTION

1. Field of the Invention

The present invention relates to a swash plate type compressor, and more particularly, to a shoe-and-socket joint between a swash plate and pistons in a swash plate type compressor.

2. Description of the Related Art

A swash plate type compressor has a rotatable swash plate, which changes a rotating motion to a linear motion, and a plurality of pistons arranged around the axis of the compressor and moving reciprocally. Compression chambers are provided on the either side of each of the pistons, and thus the pistons are known as double headed pistons. In this connection, a lateral groove is cut in each of the pistons at an intermediate position, to engage with the swash plate, and a cylinder block is formed by two axially split halves to enable an easy assembly of the compressor. Such a compressor is disclosed, for example, in the U.S. Pat. No. 4,329,913 in which ball bearings and shoes are mounted between the swash plate and the pistons.

A swash plate type compressor having a cylindrical shoe with a flat end and an opposite semi-spherical end is known and disclosed, for example, in a copending U.S. patent application Ser. No. 897,550, filed on Aug. 15, 1986, by M. Kato et al and assigned to the same assignee as in the present case. In this compressor, the swash plate passes into a swash plate engaging groove cut laterally in the piston, and a semi-spherical socket is formed in each of the opposite surfaces of the groove, and corresponding with the semi-spherical end of the shoe. Therefore, the flat end of the shoe is slidably engaged with the flat surface of the swash plate, and the semi-spherical end of the shoe is received in the corresponding semi-spherical socket in the surface of the groove.

This semi-spherical shoe-and-socket joint allows the shoe to be carried in the socket at a fixed position relative to the piston, and to move normally to the surface of the swash plate, which is inclined to the piston. Conventionally, the center of the socket is located on the axis of the piston.

A problem arises in such a swash plate type compressor having double headed pistons and a cylindrical shoe with a flat end and an opposite semi-spherical end, in that for each piston, two shoes are arranged on either surface of the swash plate one by one and, in principle, must be firmly engaged with opposite surfaces of the swash plate to make the movement reciprocal. In practice, however, there may be a minor clearance between the swash plate and the two shoes carried in the respective socket, due to, for example, the assembly of the compressor or design choice. Usually, one of the shoes is urged by the swash plate toward the associated surface of the piston groove during each stroke of the piston even if such a clearance exists. However, sometimes, when the piston is turned, both shoes are free from the urging force of the swash plate and float from the swash plate. Therefore, the piston also becomes disengaged from the swash plate which continues to rotate, and is apt to rotate around its longitudinal axis.

The swash plate engaging groove of the piston is formed by the above stated opposite surfaces with sockets and a base surface axially interconnecting the opposite surfaces. The base surface extends concentrically and outwardly of the outer circumference of the swash plate with a clearance therebetween. If the piston is caused to rotate around its longitudinal axis, one edge of the base surface thereof collides with the swash plate, which is rotating at a high speed and causes it to bounce. Then the piston rotates in the reverse direction and collides again at the other edge thereof with the swash plate. These oscillating collisions occur repeatedly until the piston is axially urged by the swash plate through the shoe, and create a noise. It is assumed by the inventors that the oscillating collisions increase if the shoe is located on the longitudinal axis of the piston, since the oscillating movement of the piston is balanced during the rotations in the forward and the reverse directions. Noise will be amplified in accordance with the number of the pistons.

SUMMARY OF THE INVENTION

It is an object of the present invention to provide a swash plate type compressor which can solve the above stated problems.

The present invention provides a swash plate type compressor comprising a cylinder block having a center axis, means for defining a central bore extending along the center axis and including an outwardly bulged portion from the central bore at an intermediate position thereof to define a swash plate chamber, and means for defining a plurality of cylinder bores axially extending in the cylinder block around the central bore, the swash plate chamber laterally opening into the cylinder bores, and a front end plate and a rear end plate mounted at either end of the cylinder block for closing the cylinder bores. A swash plate is fixedly secured on a drive shaft and inserted in the swash plate chamber, the swash plate having a pair of opposite flat surfaces inclined relative to the center axis. A plurality of pistons are slidably inserted in the cylinder bores, respectively, to provide compression chambers on either side of each of the pistons, each of the pistons having an axis parallel to the center axis and means for defining a swash plate engaging groove at an intermediate position thereof to allow passage of the swash plate therethrough and cause the piston to move reciprocally upon rotation of the swash plate. The swash plate engaging groove has a pair of opposite surfaces generally perpendicular to the center axis. According to the present invention, a shoe is arranged between each of the opposite flat surfaces of the swash plate and each of the opposite surfaces of the swash plate engaging groove. The shoe has a round end and an opposite end adapted to slidably engage with the flat surface of the swash plate. A means is provided for defining a concave round socket in each of the opposite surfaces of the swash plate engaging groove at a position offset from the axis of the piston to receive the round end of the shoe.

BRIEF DESCRIPTION OF THE DRAWINGS

The present invention will be described in greater detail regarding the preferred embodiment of the present invention in reference to the attached drawings, in which.

DESCRIPTION OF THE PREFERRED EMBODIMENTS

Figure 1:
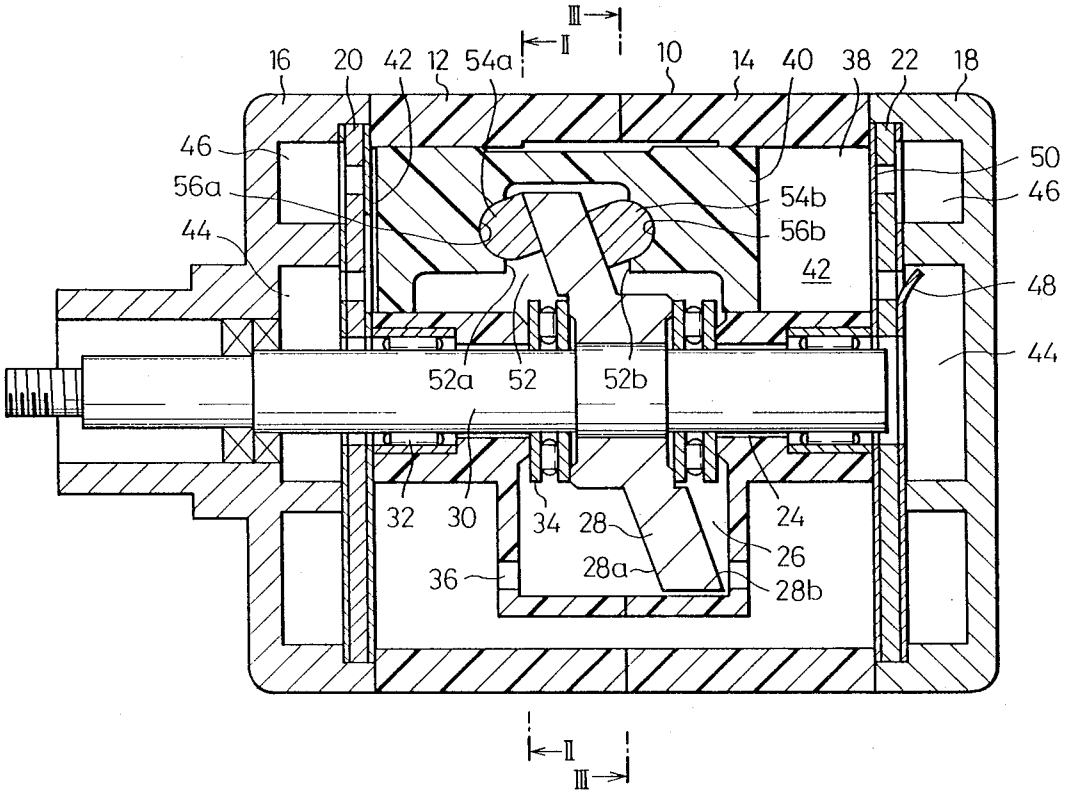
FIG. 1 is a sectional view illustrating a swash plate type compressor in accordance with the present invention.

In FIG. 1, the swash plate type compressor comprises a horizontally placed cylinder block 10 consisting of a pair of axially split cylinder block halves 12 and 14. A front end plate 16 and a rear end plate 18 are mounted on the either end of the cylinder block 10 through respective valve plates 20 and 22. The cylinder block 10 has a central bore 24 extending along the center axis of the cylinder block 10. A swash plate chamber 26 is formed by an outwardly bulged portion from the central bore 24 at an intermediate position thereof, in which a swash plate 28 is housed. The swash plate 28 is fixedly secured on a drive shaft 30 which is rotatably inserted in the central bore 24 through needle bearings 32 and adapted to be coupled to an outside drive source (not shown). The swash plate 28 is supported by the cylinder block 10 through thrust bearings 34. The swash plate chamber 26 has inlets 36 for lubricating oil contained in the coolant, which is the medium to be compressed by this compressor, to lubricate the swash plate 28. The cylinder block 10 also has a plurality of cylinder bores 38. In the illustrated embodiment, three cylinder bores 38 extend axially and equiangularly around the central bore 24 (see FIGS. 2 and 3) to slidably receive three pistons 40, respectively. Each piston 40 has an axis, as represented by the symbol L in FIGS. 2 and 3, which extends parallel to the center axis. Each piston 40 is a double headed piston and provides compression chambers 42 on either side of the piston 40 within the cylinder bore 38. The front end plate 16 and the rear end plate 18, respectively, have a centrally located discharge chamber 44 and a circumferentially located intake chamber 46. The respective valve plates 20 and 22 have a discharge valve 48 for discharge of the coolant from the compression chamber 42 to the discharge chamber 44, and an intake valve 50 for admission of the coolant from the intake chamber 46 into the compression chamber 42. The discharge valve 48 and the intake valve 50 are well known check valves. Therefore, when the piston 40 moves from the left to the right, the righthand compression chamber 42 is subjected to a compression stroke and lefthand compression chamber 42 is subjected to a suction stroke, and vice versa.

As shown in FIG. 1, the swash plate chamber 26 laterally opens into the cylinder bore 38, to thereby reach the pistons 40. Each piston 40 has a swash plate engaging groove 52 at an intermediate position thereof to allow passage of the swash plate 28 therethrough. As is known, the swash plate 28 has a pair of opposite surfaces 28*a* and 28*b*, inclined relative to the center axis. The swash plate engaging groove 52 also has a pair of opposite surfaces 52*a* and 52*b*, generally perpendicular to the center axis of the cylinder block 10 and a base surface 52*c* interconnecting the opposite surfaces 52*a* and 52*b*.

Shoes 54*a* and 54*b* are arranged between the surfaces of the swash plate 28 and the surfaces of the groove 52. Shoes 54*a* are located on the left of the swash plate 28 in FIG. 1 and shown in FIG. 2, and shoes 54*b* are located on the right, as shown in FIG. 3.

As shown in FIG. 1, each shoe 54*a* or 54*b* has a cylindrical body with a round end and an opposite flat end. This flat end is adapted to slidably engage with the flat surface 28*a* or 28*b* of the swash plate 28. A concave round socket 56*a* or 56*b* is formed in each of the opposite surfaces 52*a* or 52*b* of the swash plate engaging groove 52 of the piston 40. The round end of the shoe 54*a* or 54*b* and the concave round socket 56*a* or 56*b* are formed by a conforming semi-spherical configuration, so that the round end of the shoe 54*a* or 54*b* can be received in the socket 56*a* or 56*b*. Therefore, the shoe 54*a* or 54*b* can be carried by the piston 40 at a fixed position relative to the piston 40.

The center of curvature of the semi-spherical socket 56*a* or 56*b* is represented by the symbol C in FIGS. 2 and 3, in which the center of curvature C is located at a position circumferentially offset from the axis L of the piston 40. More particularly, the center of curvature C is located at a position on a circle having a center on the center axis of the compressor and a radius defined by the distance from that center to the axis L of the piston. Therefore, the center of curvature C and the axis L are located on a common circle but the center of curvature C is circumferentially offset from the axis L of the piston 40.

The rotational direction of the swash plate 28 is shown by the arrow in FIGS. 2 and 3. Referring to FIG. 2, the centers C of two of the three sockets 56*a*, as shown at the top and left sides, are forwardly offset from the axis L in view of the rotation of the swash plate 28 and the remaining socket 56*a* is offset to the back. This disposition is the same as that of FIG. 3 (note that FIG. 3 is a view of the reverse of FIG. 2).

Figure 2A:
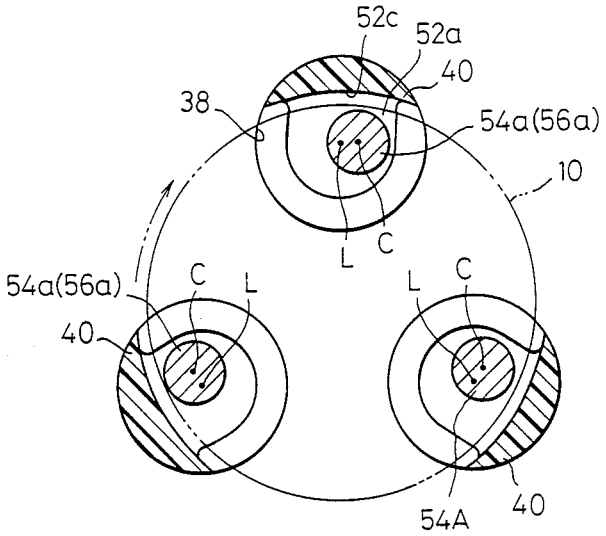
FIGS. 2A and 2B are sectional views taken along the line II—II in FIG. 1, illustrating the positions of the pistons and shoes on one side from the swash plate in the different positions.
Figure 2B:
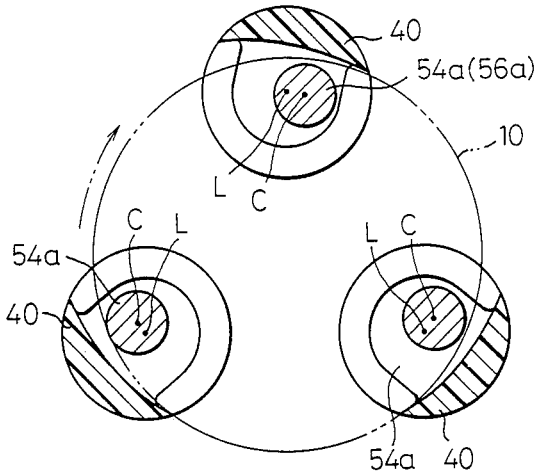
Figure 3A:
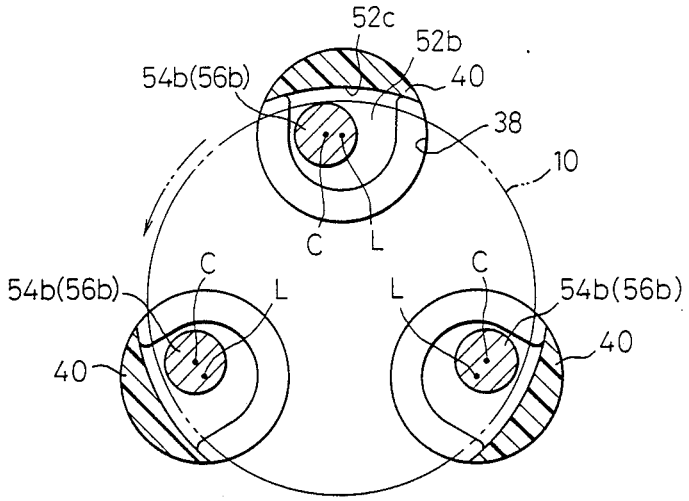
FIGS. 3A and 3B are sectional views taken along the line III—III in FIG. 1, illustrating the positions of the pistons and shoes on the other side from the swash plate.
Figure 3B:
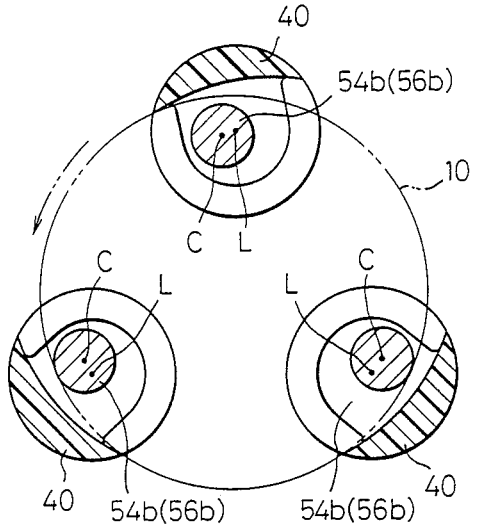

In operation, the rotating swash plate 28 is in sliding engagement with the flat ends of the shoes 54*a* and 54*b* and urges the shoes 54*a* and 54*b* to cause the pistons 40 to move reciprocally, thereby effecting the compression and suction strokes on either side of the piston 40, alternatively. Considering one of the pistons 40, the swash plate 28 urges the righthand shoe 54*b* during the compression stroke of the righthand compression chamber 44 in FIG. 1 and then turns to urge the lefthand shoe 54*a* to commence the compression stroke of the lefthand compression chamber 44. At the time that the piston 40 turns, both of the shoes 54*a* and 54*b* may be free from the swash plate 28, because of the clearance of the assembly, with the result that the piston 40 becomes free from the swash plate 28 and may oscillatingly rotate around the axis L of the piston to create noise, as explained previously. According to the present invention, the balance of the piston 40 around the axis L is lost and the swinging pendulum motion of the piston 40 which causes this noise is prevented, since the socket 56*a* or 56*b* is circumferentially offset from the axis L of the piston 40. The unbalance occurs in the offset center of the gravity of each piston 40 and is caused by the circumferential frictional force of the swash plate 28. As shown in FIGS. 2A and 3A, it can be seen that the top shoes 54*a* and 54*b* are offset on the righthand side from the vertical plane passing the axis L, which affects and shifts the center of the gravity of the top piston assembly, and similarly, the left bottom shoes 54*a* and 54*b* are offset on the lefthand side from the vertical plane passing the axis L and the righthand shoes 54*a* and 54*b* are offset on the righthand side, to further shift the center of the gravity. By this shift of the center of the gravity, each piston 40 is inclined, as shown in FIGS. 2B and 3B, in view of the clearance between the base surface of the groove 52 and the outer periphery of swash plate 28. In FIG. 2B, for example, the righthand edge of the top piston 40 is pressed against the outer periphery of the swash plate 28 by the force of gravity and will not be forced off by the swash plate and collide again with the swash plate 28 at the lefthand edge thereof. This means that the oscillating swinging motion of the piston 40 is prevented and the noise is decreased. Although the axial urging force from the swash plate 28 toward the piston 40 in the instance in question is decreased, some frictional contact occurs between the swash plate 28 and the shoes 54*a* and 54*b*. This frictional contact will trail the shoes 54*a* and 54*b*, circumferentially of the swash plate 28 and assists the offset center of gravity in maintaining the inclined position of the piston 40, as shown in FIGS. 2B and 3B.

As explained, according to the present invention, the oscillating swinging motion of the pistons is prevented and the noise can be decreased.

While the above description is explained in reference to a single preferred embodiment, a variety of modifications can be made within the scope of the present invention. For example, the position of the shoe can be shifted to other side, for example, radially of the swash plate, rather than the circumferentially of the swash plate, and a ball can be used for the shoe.

We claim:

1. A swash plate type compressor comprising:

a cylinder block having a center axis, means for defining a central bore extending along said center axis and including an outwardly bulged portion from said central bore at an intermediate position thereof to define a swash plate chamber, and means for defining a plurality of cylinder bores axially extending in said cylinder block around said central bore, said swash plate chamber laterally opening into said cylinder bores;

a front end plate and a rear end plate mounted at either end of said cylinder block for closing said cylinder bores;

a drive shaft rotatably inserted in said center bore;

a swash plate fixedly secured on said drive shaft and inserted in said swash plate chamber, said swash plate having a pair of opposite flat surfaces inclined relative to said center axis;

a plurality of pistons slidably inserted in said cylinder bores, respectively, to provide compression chambers on either side of each of said pistons, each of said pistons having an axis parallel to said center axis and means for defining a swash plate engaging groove at an intermediate position thereof to allow passage of said swash plate therethrough to cause said piston to move reciprocally upon rotation of said swash plate, said swash plate engaging groove having a pair of opposite surfaces generally perpendicular to said center axis of said cylinder block;

a shoe arranged between each of said opposite flat surfaces of said swash plate and each of said opposite surfaces of said swash plate engaging groove, said shoe having a round end and an opposite end adapted to slidably engage with said flat surface of said swash plate;

means for defining a concave round socket in each of said opposite surfaces of said swash plate engaging groove at a position offset from said axis of said piston to receive said round end of said shoe; and said concave round socket comprising a semi-spherical concave surface and said round end of said shoe comprising a semi-spherical convex surface conforming to said socket, and said semi-spherical concave surface of said concave round socket has a center of curvature which is at a position on a circle having a center on said center axis and a radius and circumferentially offset from said axis of said piston.

2. A swash plate type compressor according to claim 1, wherein said radius is defined by the distance from said center to said axis of said piston.

3. A swash plate type compressor according to claim 1, wherein said center of said semi-spherical concave surface is forwardly offset from said axis of said piston in view of the rotation of said swash plate.

4. A swash plate type compressor according to claim 1, wherein said center of said semi-spherical concave surface is backwardly offset from said axis of said piston in view of the rotation of said swash plate.

5. A swash plate type compressor according to claim 1, wherein said cylinder block comprises a pair of axially split cylinder block halves.

6. A swash plate type compressor according to claim 1, wherein each of said front and rear end plates has a centrally located discharge chamber and a circumferentially located intake chamber, and a valve plate is arranged between the end of said cylinder block and each of said front and rear end plates, said valve plate having a discharge valve and an intake valve to interconnect said compression chamber and said discharge chamber and said intake chamber, respectively.

* * * * *